United States Patent [19]

Sewell et al.

[11] Patent Number: 4,515,299

[45] Date of Patent: May 7, 1985

[54] METHOD FOR HANDLING HOSIERY

[75] Inventors: James H. Sewell, Charlotte, N.C.; Hans Gaede, Fort Mill, S.C.; Curtis R. Ritch, High Point, N.C.

[73] Assignee: Intech Corporation, Charlotte, N.C.

[21] Appl. No.: 539,297

[22] Filed: Oct. 5, 1983

Related U.S. Application Data

[62] Division of Ser. No. 250,636, Apr. 3, 1981, Pat. No. 4,421,259.

[51] Int. Cl.[3] ..... D06C 5/00

[52] U.S. Cl. ..... 223/76; 223/112

[58] Field of Search ..... 223/75, 76, 77, 112, 223/60

[56] References Cited

U.S. PATENT DOCUMENTS

| | | | |
|---|---|---|---|
| 1,190,119 | 7/1916 | Coulston . | |
| 1,348,922 | 8/1920 | Ash . | |
| 1,472,978 | 11/1923 | Hanes . | |
| 1,560,415 | 11/1925 | Dennison . | |
| 1,669,251 | 5/1928 | Kienel . | |
| 1,897,886 | 2/1933 | Brand et al. | 223/76 |
| 1,957,376 | 5/1934 | Wanamaker | 223/76 |
| 2,154,369 | 4/1939 | Wanamaker | 223/75 |
| 2,166,053 | 7/1939 | Heliot | 223/112 |
| 2,221,669 | 11/1940 | Brewin . | |
| 2,343,170 | 2/1944 | Clarke | 223/76 |
| 3,096,006 | 7/1963 | Glaze | 223/60 |
| 3,103,302 | 9/1963 | Minton | 223/39 |
| 3,343,732 | 9/1967 | Glaze, Jr. | 223/75 |

*Primary Examiner*—Louis K. Rimrodt

*Attorney, Agent, or Firm*—Banner, Birch, McKie & Beckett

[57] ABSTRACT

A method and apparatus (12) for handling hosiery is disclosed. A generally flat form (14) dimensioned to be inserted into hosiery is supported for motion on a conveyor chain (18). The form (14) is driven by a loading station (34) where hosiery is placed upon the form (14). A clamp mechanism (46) is carried on the form (14) for vertical motion along its length. The form (14) is thereafter moved past an elevator mechanism (16). The elevator mechanism (16) moves the clamp mechanism (46) upward until it contacts a bottom portion of the hosiery on the form and moves the bottom portion of the hosiery upward. Clamp jaws (52) of the clamp mechanism (46) thereafter clamp down on the hosiery placed on the form (14). After the jaws (52) have been clamped on the hosiery, the clamp mechanism (46) is forced downwardly by a cam plate (202).

20 Claims, 9 Drawing Figures

METHOD FOR HANDLING HOSIERY

This application Ser. No. 250,636, filed Apr. 3, 1981, now U.S. Pat. No. 4,421,259, granted Dec. 20, 1983.

TECHNICAL FIELD

The present invention relates to the field of hosiery manufacture. More particularly, the present invention relates to a method and an apparatus for handling hosiery during processing, for example during drying and/or setting.

BACKGROUND OF THE INVENTION

In hosiery processing, the hosiery must frequently be carried through various processing stations, such as drying, shaping, or inspection stations. During the processing, the hosiery, such as socks or stockings, is carried on shaped forms.

During a drying process, the hosiery may be held or clamped to the form to prevent shrinkage beyond a desired degree. In current prior art devices, the hosiery is manually positioned on a form to a particular length and thereafter clamped. This method of clamping is somewhat time consuming and relatively inaccurate. As a result, hosiery frequently exits the drying process in non-uniform lengths. The hosiery thereafter must be manually sorted and paired. Such an additional step is also both time consuming and expensive.

SUMMARY OF THE INVENTION

The present invention relates to a method and an apparatus for handling hosiery and the like during processing. The method includes the steps of placing a piece of hosiery on a form; moving a clamp mechanism upward along the length of the form until a portion of the clamp mechanism contacts and moves a bottom portion of the hosiery upward with the clamp jaws of the clamp mechanism in an open position; closing the clamp jaws after the bottom portion of the hosiery has been moved upward; and moving the closed clamp jaws and the hosiery held thereby downward.

The apparatus is comprised of a form dimensioned to be inserted into hosiery and supported for motion to carry the hosiery during processing. A clamp means is carried with the form and is movable upward and downward along the length of the form, and between a clamped position to secure the hosiery to the form and an unclamped position. A means discrete from the form raises the clamp means to a desired height. A clamp actuating means is provided for moving the clamp means between its unclamped and clamped positions. The clamp actuating means is correlated with the stop means and the clamp raising means to move the clamp to its clamped position after the clamp has contacted a bottom of hosiery placed on the form and moved the bottom of the hosiery upward a distance.

In a preferred embodiment, the stop means is vertically adjustable to stop the raising means at any one of a plurality of heights. The clamp means includes a clamp body and a pair of clamp jaws pivotable between open and closed positions. The clamp body has an upper surface for contacting a bottom of hosiery placed on the form and the clamp jaws each have a contact edge for contacting the hosiery placed on the form. The contact edge is disposed above the upper surface of the clamp body when the clamp jaws are in their closed position.

A means is provided for camming the clamp means downward after the clamp jaws have pivoted to the closed position onto hosiery placed on the form. Thus, after the clamp means has pushed the bottom edge of hosiery on the form upward a slight degree and clamped the bottom edge, the clamped hosiery is pulled or cammed downward a predetermined amount by the camming means. In this manner, the hosiery need not be placed precisely on the form. Rather, if the hosiery is placed only approximately at a proper position, the clamp mechanism of the present invention will move it upward to a precise desired location and, thereafter, pull the hosiery down a precise amount to hold the sock at exactly the desired position. Precise manual alignment of the hosiery on the form is not required. The need for manual assortment of the hosiery after drying is also eliminated.

Various advantages and features of novelty which characterise the invention are pointed out with particularity in the claims annexed hereto and forming a part hereof. However, for a better understanding of the invention, its advantages, and objects attained by its use, reference should be had to the drawings which form a further part hereof and to the accompanying descriptive matter, in which there is illustrated and described a preferred embodiment of the invention.

DETAILED DESCRIPTION OF THE INVENTION

Figure 1:
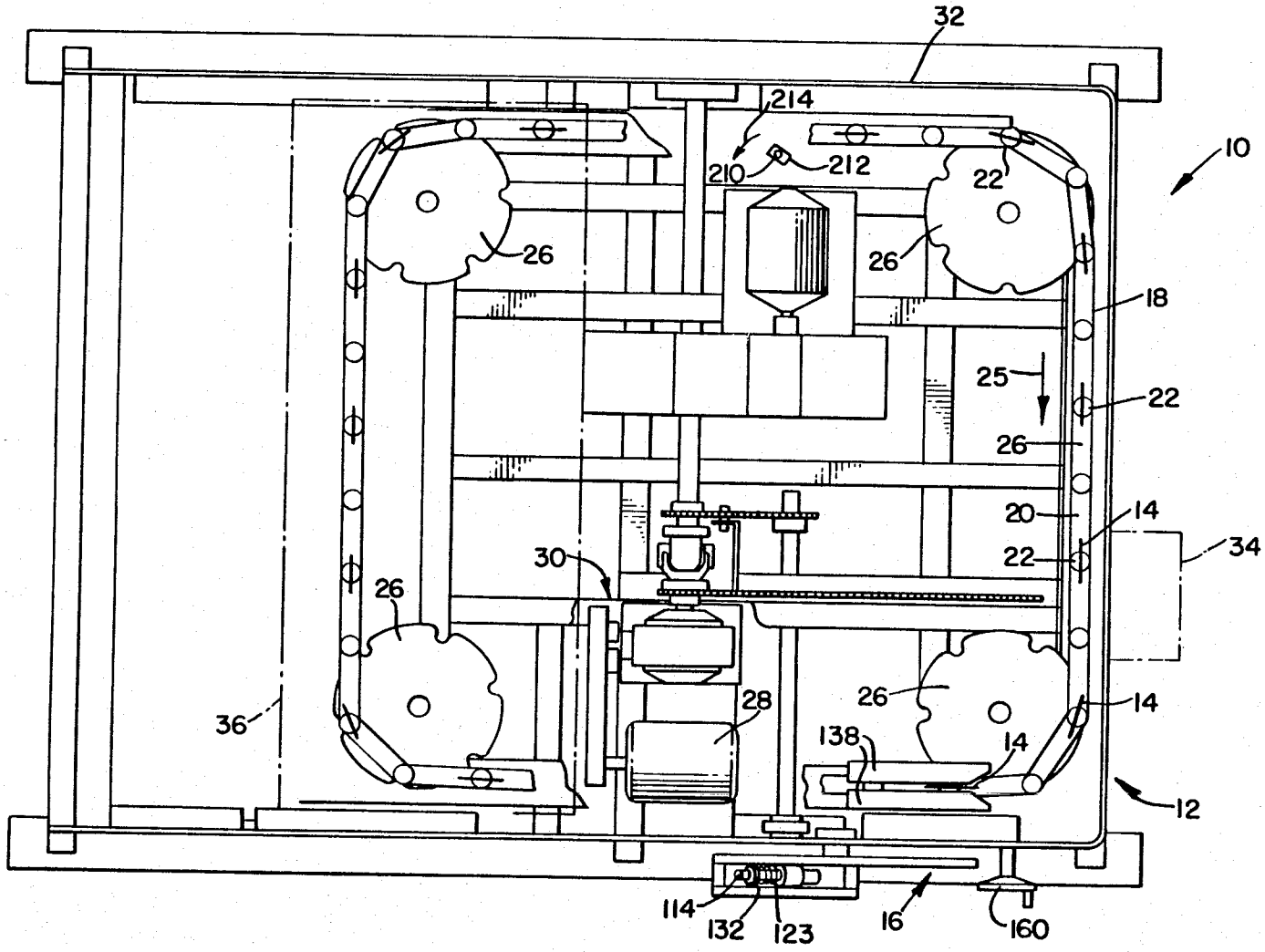
FIG. 1 is a diagrammatic top plan view of a hosiery processing machine.

Referring to the drawings in detail, wherein like numerals indicate like elements, there is shown in FIG. 1 a hosiery processing machine designated generally as 10. A hosiery handling apparatus is designated generally as 12. The hosiery handling apparatus 12 includes a movable form 14 and a lifter or elevator mechanism 16. The form 14 is movably supported on a driven conveyor chain 18. The conveyor chain 18 is made up of a plurality of links 20 pivotally connected to one another. A collar 22 is attached to some of the links 20. A pin 24 extends downward from the bottom of each form 14 and is received within one of the collars 22. The forms 14 thus extend vertically upward and are conveyed in a horizontal direction indicated by arrows 25 by the chain 18. The conveyor chain 18 is trained about a plurality of gears 26, one of which is driven by a conventional power source. The conventional power source includes an electric motor 28 and a transmission 30. Since the motor and transmission 28, 30 are of conventional design, they will not be discussed in detail. The hosiery processing machine 10, including the gears 26, conveyor chain 18, electric motor 28 and transmission 30 are supported on a frame 32.

The conveyor chain 18 carries the forms 14 past a loading station 34, past the elevator mechanism 16, which serves as a clamping station, and through a further processing section, such as a dryer shown in phantom line as 36. Hosiery such as socks, stockings or the like, are manually placed on the forms 14 at the loading station 34. A sock 35 is shown on the form 14. Hosiery carried on the form is securred or clamped thereto at the clamping station. The hosiery is thereafter carried on the form 14 through the dryer 36. After leaving the dryer 36 the clamp is released and the hosiery is manually removed from the form.

Figure 3:
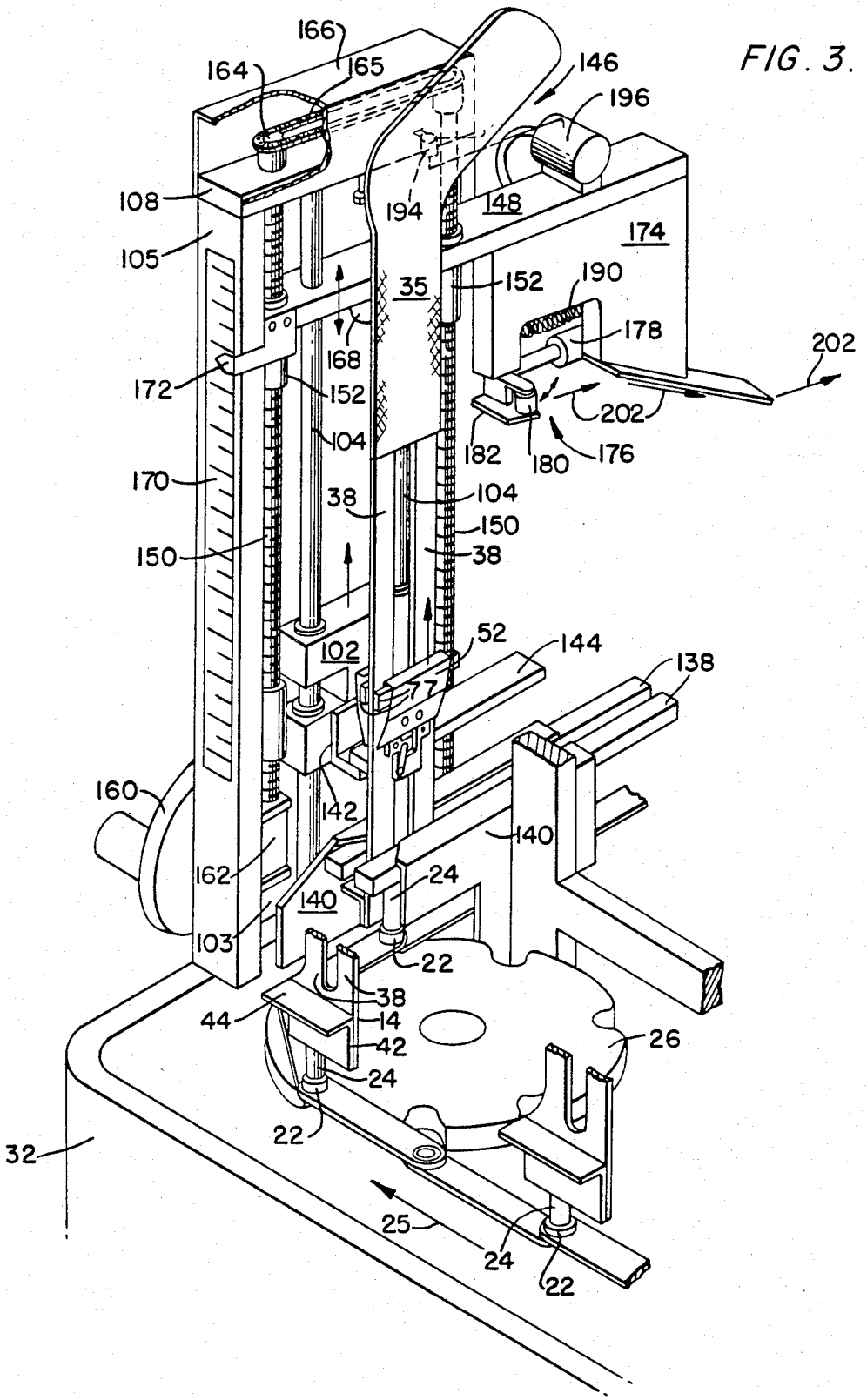
FIG. 3 is an enlarged perspective view illustrating the hosiery form, clamp and clamp raising mechanism.
Figure 6:
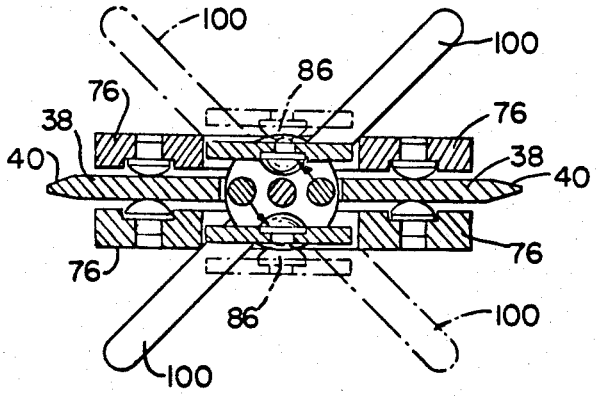
FIG. 6 is a sectional view taken generally along lines 6—6 of FIG. 4.

The form 14 has a generally flat body formed of any suitable material, such as light weight metal or plastic. The form 14 is preferably made of a single piece of material with an upper end shaped to conform to the shape of the hosiery to be held on the form 14. The medial portion of the form 14 has a slot formed through it to define a pair of spaced parallel upwardly extending flat plates 38 with their upper and lower ends joined. As best seen in FIG. 6, the outer edges 40 of the plates 38 are bevelled to avoid sharp corners. An angle plate 42 including a horizontally extending section 44 is attached at the lower end of form 14 (FIG. 3). The pin 24 is attached to and extends downward from the lower end of the form 14.

Figure 4:
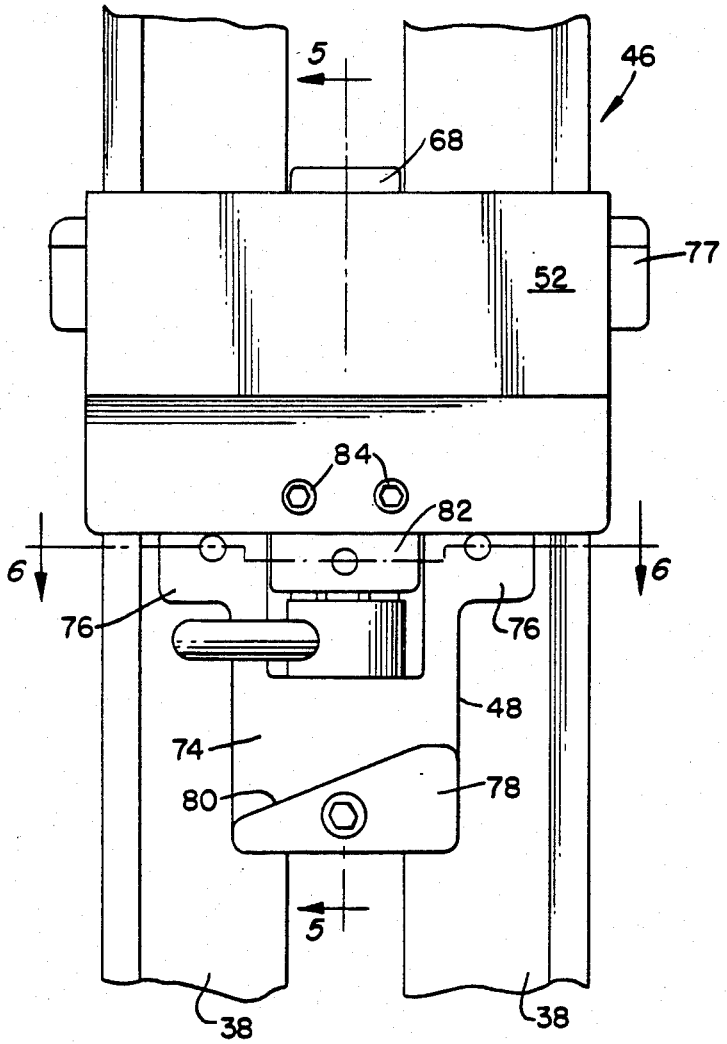
FIG. 4 is an enlarged elevational view of a portion of the form and clamp.
Figure 5:
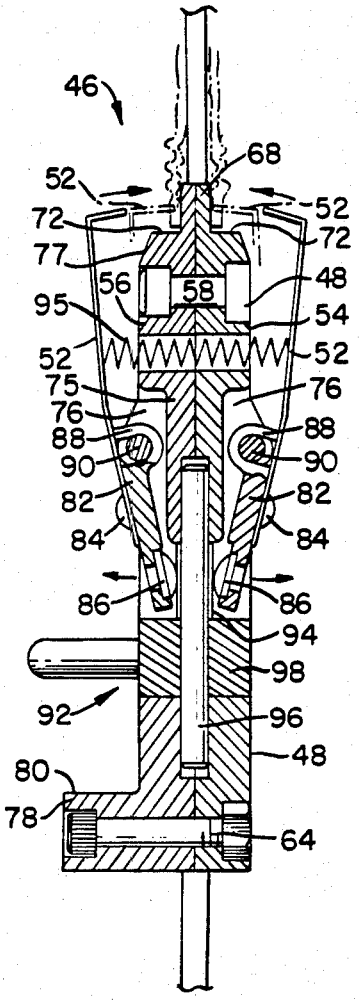
FIG. 5 is a sectional view taken generally along line 5—5 of FIG. 4.

A clamp mechanism 46, shown in detail in FIGS. 4, 5 and 6, is slidably carried on the form 14. The clamp mechanism 46 includes a clamp body 48, and a pair of clamp jaws 52 pivotably connected to the clamp body 48. The clamp body 48 is made up of a pair of like facing members 54, 56 connected to one another by a screw 58 and by a nut and bolt assembly 64. The clamp body 48 includes a base section 74, a pair of upwardly extending side sections 76 about each face of each plate 38, a central section 75 and upper cross bar 77 extending between side sections 76. A pair of generally horizontal ledges 72 form the top of the bars 77 and a ridge 68 extends upwardly therefrom in the area between plats 38. The horizontal ledges 72 form upper contact surfaces for contacting a lower end of the sock 35 placed on the form 14. A flange 78 extends outward from the lower portion of one face of the base section 74 and has an upwardly facing, slanted camming surface 80.

Each clamp jaw 52, preferably made of a spring type metal, is attached to a support plate 82 by a pair of screws 84. A wear or contact button 86 is connected to the lower end of each support plate 82 and has a contact surface facing inwardly. Each support plate 82 has a hooked upper end 88 forming an opening for the reception of a support pin 90. Each support pin 90 extends between a pair of associated side sections 76 and is received within apertures of the side sections 76. The support plate 82 is supported within a recessed area of the clamp body 48 between the side section 76. The clamp jaws 52 are thus supported for pivotable motion about the pins 90.

An eccentric assembly 92 pivots the jaws 52 between the open position shown in full line in FIG. 5 and the closed position shown in phantom line in FIG. 5. The eccentric assembly 52 includes an eccentrically shaped collar 94 connected to a rotatable pin 96 for rotation therewith. The lower end of the pin 96 is received with an opening in the base section 74 of the clamp body 48 and the upper end of the pin 96 is received within an opening in the central section 75 of the clamp body 48. A support cylinder or block 98 is fixed to the pin 96 for rotation with it and is supported above the base section 74. An actuator arm 100 extends outward of the block 98 at 180° intervals. An arm 100 thus extends outward from the face of each jaw 52. As will be explained more fully hereinafter, the arms 100 are actuated externally to rotate the eccentric collar 94 and, thereby, pivot the jaws 52. That is, as the broader portion of the eccentric collar 94 rotates into contact with the buttons 86, the jaws 52 pivot closed. As the narrower portion of the eccentric collar 94 rotates into contact with the buttons 86, the jaws 52 pivot open under a gravity bias or under the bias of spring 95 which extends through an opening through the clamp body 48.

Figure 2:
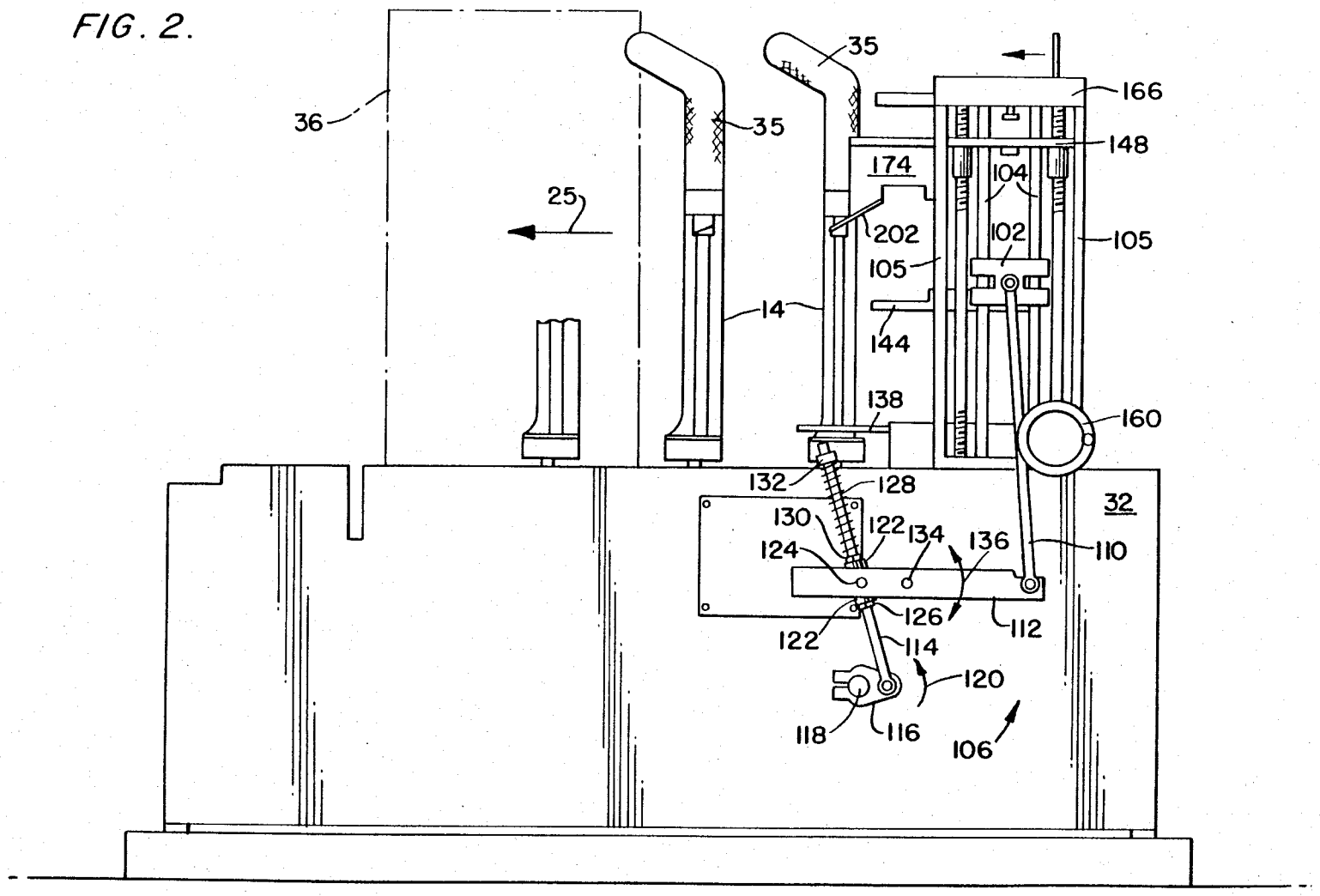
FIG. 2 is a side elevational view illustrating the clamp raising mechanism.
Figure 7:
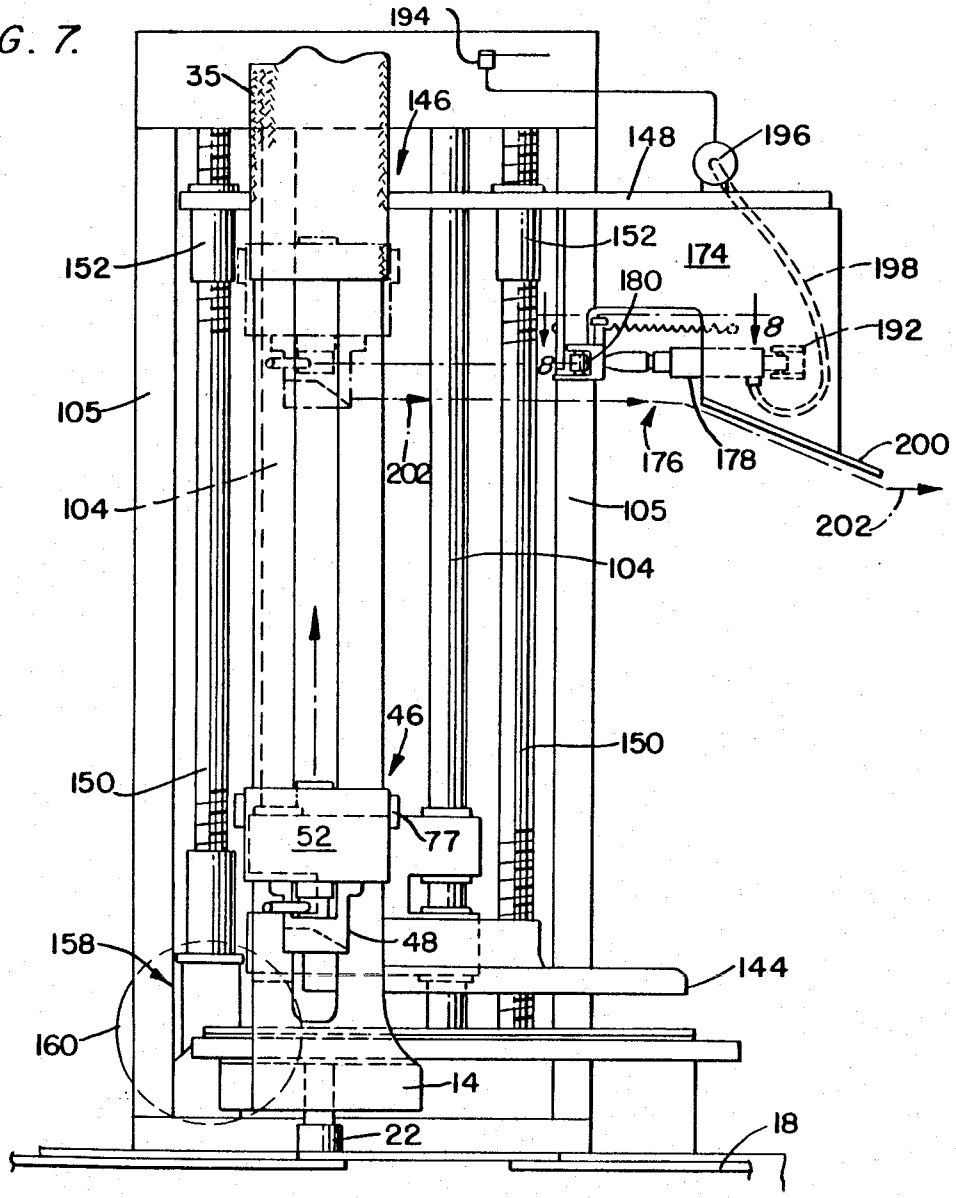
FIG. 7 is an elevational view of the form, clamp and clamp raising mechanism.

Details of the elevator mechanism 16 can best be seen in FIGS. 2, 3 and 7. The elevator mechanism 16 includes a generally H-shaped slide block or member 102 supported for sliding motion along a pair of spaced parallel, vertically extending slide shafts 104. The block 102 is moved upwardly and downwardly along the shafts 104 by a drive assembly 106. The lower ends of the shafts 104 are connected to a base 103, which is supported on the frame 32, and their upper ends are connected to an upper support bar 108. A pair of spaced, vertically extending upright members 105 are connected to and extend between the base 103 and the upper support bar 108.

The drive asembly 106 includes a push rod 110, an actuator or lever arm 112, a coupling shaft 114, a crank 116, and a drive shaft 118. The drive shaft 118 is coupled to the transmission 30 so that the upward and downward motion of the slide 102 is coordinated to the drive of the chain 18 and, hence, to the motion of the forms 14 past the clamping station.

The drive shaft 118 and attached crank 116 are rotated in the direction of arrow 120. The lower end of coupling shaft 114 is pivotably connected to an outer portion of the crank 116 so that it revolves about the axis of shaft 118. The shaft 114 extends upwardly from its connection to the crank 116 through a hollow swivel housing 122 and for a distance thereabove. The swivel housing 122 is generally a hollow tube and is pivotably connected to the actuator arm 112 by bearings 124. A set collar 126 is fixed to the shaft below the swivel housing 122 and a compression spring 128 is received about the shaft 114 above the arm 112. The spring 128 is held about the shaft 114 between a lower retaining collar 130 and an upper retaining collar 132. The retaining collars 130, 132 are removably fixed in position on the coupling shaft 114.

The actuating arm 112 pivots about a bearing or pin 134 connected to the frame 32. The actuator arm 112 pivots upwardly and downwardly in the direction indicated by arrows 136. The lower most end of the push rod 110 is pivotably connected to an end of the actuator arm 112, and the upper end of the push rod 110 is pivotably connected to the center of the slide block 102. The upperward and downward pivoting of the actuator arm 112 thus moves the slide block 102 upwardly and downwardly along the slide shafts 104. The shaft 114 is not fixedly connected to the swivel housing 122. To cause downward pivoting motion of the right side of the actuator arm 112 (as viewed in FIG. 2) the set collar 126 contacts the bottom swivel housing 122 and serves as an abutment to push the left end of the actuator arm 112 upward about the axis of bearing 134 as the rotation of the crank 116 moves the coupling shaft 114 upward. During the downward motion of the shaft 114, its position relative to the actuator arm 112 is fixed by the compression spring 128 as long as the slide block 102 is free to move upward along the slide shafts 104. As will be explained more fully hereinafter, a stop mechanism is provided for stopping the upward motion of the slide block 102 at various vertical heights less than the maximum height to which the push rod 110 can move the block 102. When the stop mechanism prevents the block 102 from moving to its maximum height, the rod 114 continues to be pulled downward through the swivel housing 122 against the force of compression spring 128. As this occurs, the push rod 110 and the actuator arm 112 are prevented from moving by the stop mechanism.

As seen in FIG. 3, the lower end of a form 14 is guided past the elevator mechanism 16 between a pair of spaced parallel guide blocks 138. Each guide block 138 is attached to the frame 32 by an extended angle bracket 140. A flange 142 is attached to the front face of the bearing block 102 and has an extended horizontal support surface 144. As the form 14 passes the slide block 102, the lower surface of the flange 78 slides over the support surface 144. As the slide block 102 is driven upward, the clamp mechanism 46 is carried upward while the form 14 still proceeds to move past the clamping station.

A stop mechanism, designated generally as 146, stops the upward motion of the slide block 102 at any of a plurality of vertical locations. The stop mechanism 146 includes a generally horizontally disposed cross bar 148 coupled to a pair of spaced parallel, vertically extending lead screws 150. A pair of lead nuts 152 are mounted within holes in the cross bar 148 and are received about the lead screws 150. Rotation of the lead screws 150 will raise or lower the lead nuts 152 and the attached cross bar 148. The lead screws 150 extend between the base 103 and the upper support bar 108. One of the lead screws 150 is rotatably carried by bearings in the base 103 and upper support member 108. The other lead screw is rotatably carried by a bearing in the upper support member 108 and a manual actuator 158 supported by the base 103.

The manual actuator 158 includes a rotatable hand wheel 160 connected to a conventional gear box 162. The gear box 162 in turn is connected to one of the lead screws 150. Thus, rotation of the hand wheel 160 is transmitted as rotary motion to one of the lead screws 150. To transmit the rotary motion of the one lead screw 150 to the other lead screw 150, a sprocket 164 is attached to the upper end of each lead screw 150 and a chain 165 is trained about the two sprockets 164. In this manner, the two lead screws 150 can be rotated in unison and the cross bar 158 can be evenly raised or lowered. A housing 166 is attached to the upper support member 108 and surrounds the sprockets 164 and the chain 165. A bumper 168 is attached to and extends downwardly from the bottom surface of the cross bar 148 in the area between the slide shafts 104. The bumper 168 is the contact point with the slide block 102. An indicator scale 170 is attached to the side of one of the upright members 105. A pointer 172 is attached to the cross bar 148 and extends around the upright member 105 and overlaps the face of the scale 170. The scale 170 is proportioned to indicate the lengths of hosiery to be clamped on the form 14 at a given vertical position of the stop mechanism 146.

Figure 8:
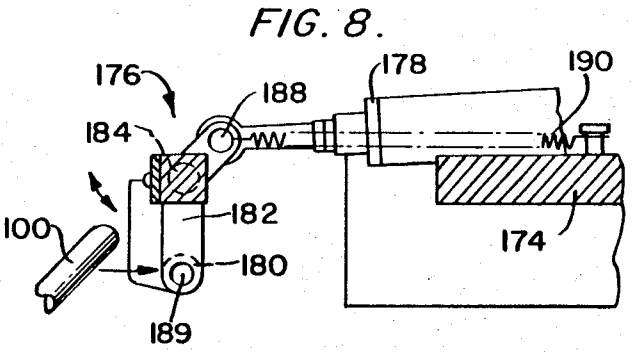
FIG. 8 is a sectional view taken generally along line 8—8 of FIG. 7.
Figure 9:
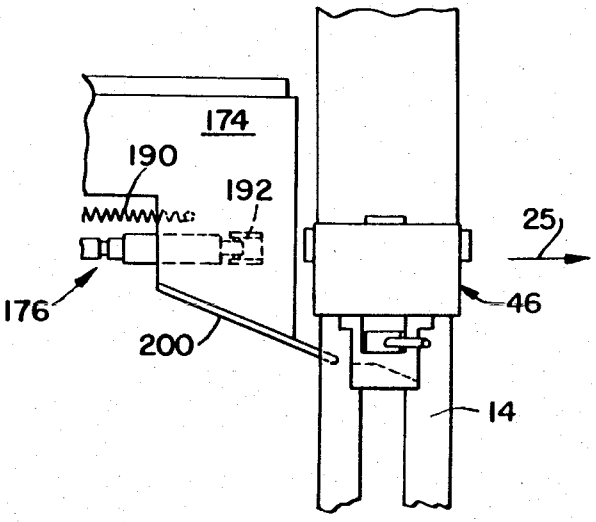
FIG. 9 is a partial elevational view illustrating the clamp after it has been cammed downward.

A support plate 174 is attached to and extends downwardly from the downstream end of the cross bar 148. An external clamp jaw actuator assembly 176 is attached to the support plate 174. The actuator assembly 176 includes an air cylinder 178 and a contact roller or bumper 180. A bumper retainer 182 is pivotably attached to the lower end of a leg of the support plate 174 by a pin or bearing 184. The retainer 182 has a generally C-shaped configuration facing in two directions. The contact bumper 180 is received within the open area of the general C-shape at one end of the retainer 182 and a rod end 186 of the air cylinder 178 is received within an open area of the general C-shape at the other end of the retainer 182. A coupling pin 188 connects the rod end 186 to the retainer 182 and a coupling pin 189 connects the bumper 180 to the retainer 182. A first end of a spring 190 is also connected to the pin 188. The other end of the pin 190 is connected to the support plate 174. A connection block 192 pivotably connects the other end of the air cylinder 178 to the support plate 174. The air cylinder 178 is a single acting cylinder. When pressurized air is supplied to the cylinder 178, the rod end 186 extends outwardly against the bias of spring 190. This motion pivots the retainer 182 in a counter-clockwise direction as viewed in FIG. 8. When the rod end 186 is fully extended and the retainer 182 is thus pivoted, the bumper 180 is moved out of the path of the pin 100. When no pressure is applied to the cylinder 178, the spring 190 holds the retainer 182 in the position shown in FIG. 8. In this position, the bumper 180 is in the path of pin 100 to actuate the closing of the clamp jaws 52.

A sensor, preferably in the form of a resistant sensor 194 is attached to the housing 166. The sensor 194 is connected to a solenoid valve 196 which controls the flow of pressurized air to the cylinder 178 through tubing 198. The form 14 is preferably made of a metalic material. When a sock is not on the form 14 and the form 14 is constructed of metal, a circuit is completed through the resistance sensor 194 when the form 14 comes in contact with a contact finger of the sensor 194. With the circuit complete, the solenoid valve 196 applies pressurized air to the cylinder 178 to retract the bumper 180 out of the path of the pin 100. Thus, the clamp jaw will not clamp down upon bare metal of the form 14. If a sock is present on the form 14, the circuit is not completed and the bumper 180 remains in the path of the pin 100 under the bias of spring 190.

A cam plate 200 is attached to the downstream most end of the support plate 174. As the form 14 moves past the clamping station, the lower surface of the flange 78 leaves contact with the support surface 144 and the upper camming surface 80 comes into contact with the lower surface of the cam plate 200. As indicated by arrows 202, the cam plate 200 forces the clamp mechanism 46 downward to thereby move the sock to its desired length. The amount of motion or stretching is accurately controlled by the cam plate 200.

A method of handling hosiery, in accordance with the present invention, and the manner of operating the hosiery handling apparatus 12 are as follows. A piece of hosiery, such as sock 35 is manually placed on the form 14 at a loading station 34. For a given length, the sock should be manually aligned on the form within plus or minus one inch of a set point. As will be explained hereinafter, this relatively imprecise locating of the sock 35 is corrected or adjusted automatically by the manner in which the sock 35 is clamped to the form 14. After leaving the loading station 34, the form 14 is carried by the conveyor chain 18 to the elevator mechanism 16. At the elevator mechanism 16, the lower surface of the flange 78 comes in sliding contact with the support surface 144, as the drive chain 18 continues to move the form 14. The drive assembly 106 of the slide block 102 is coordinated with the drive of the chain 18 so that the support surface 144 is aligned with the lower surface of the flange 78 as a form 14 approaches it. As the flange 78 slides over the support surface 144, the drive assembly 106 moves the slide block 102, and, hence, the clamp mechanism 46 upwardly.

The stop mechanism 146 has been preset for the particular length of socks being placed on the form 14 by turning the hand wheel 160 until the pointer 172 is aligned with the particular length indicated on the scale 170. With the sock 35 only approximately located on the form 14 for a given length, the clamp jaws 52 will clamp down on only small amount of material gathered upon the ledges 72 above clamp surface of jaw. If the sock has been pulled down too far, excess material will gather above the ledges 72 and not be held by the clamp jaws 52. After the clamp mechanism 46 has been moved upwardly to its maximum intended extend and the bottom of the sock on the form has been contacted and moved upward, the clamp jaws are pivoted to their closed position. As seen in FIG. 3, the clamp jaws 52 are open and the pin 100 is in its clockwise most position as the clamp mechanism 46 is moved upward. As the pin 100 is moved past the bumper 180 by the continued motion of the form 14 on chain 18, it is rotated to its counterclockwise most position and the eccentric shaped collar 94 rotates so that its thickest portion abuts the wear buttons 86 to pivot the clamp jaws 52 to their closed position.

As the flange 78 leaves contact with the support surface 144, the upper camming surface 80 of the flange 78 contacts the bottom of cam plate 200 and the clamp mechanism 46 are forced downwardly a set amount, i.e., to the lower most end of the cam plate 200. The bottom of the sock held by the clamp jaws 52 is thereby moved downwardly a set amount. The clamp jaws 52 are of a spring type metal and frictionally hold the clamp mechanism 46 to the sock form 14 without sliding downward. The sock is held at an accurate position, even if the sock is only approximately located on the form 14 because of the upward pushing of the sock by the clamp mechanism 46, followed by the clamping of a small portion of the sock and the pulling downward of the sock by the camming action of the cam plate 200. The form 14 thereafter is passed through further processing stations, such as dryer 36. After leaving the dryer 36 the opposite end of pin 100 comes in contact with a release bumper to pivot the jaws 52 to the open position so that the sock may be removed from the form 14 and the clamp mechanism 46 drops to its lowermost position. The release bumper is preferably in the form of a vertically extending rod 210. The rod 210 is held between a pair of arms 212 (one of which is shown) and is pivotable in the direction of arrow 214.

Numerous characteristics and advantages of the invention have been set forth in the foregoing description together with details of the construction and function of the invention. The novel features thereof are pointed out in the appended claims. The disclosure, however, is illustrative only, and changes may be made in detail, especially in matters of shape, size, and arrangement of parts, within the principle of the invention, to the full extent indicated by the broad general meaning of the terms of which the appended claims are expressed.

We claim:

1. A method of handling hosiery comprising the steps of:

(a) placing a piece of hosiery on a form;

(b) moving a clamp mechanism upward along the length of the form until a portion of the clamp mechanism contacts and moves a bottom portion of the hosiery upward;

(c) closing clamp jaws of the clamp mechanism onto the bottom portion of the hosiery after performing step (b); and (d) moving the closed clamp jaws, and the bottom of the hosiery held thereby, downward.

2. A method in accordance with claim 1 including a step of moving the form in a generally horizontal direction while performing steps (b), (c) and (d).

3. A method in accordance with claim 2 wherein step (d) includes contacting a portion of said clamp mechanism with a cam plate sloping downwardly in the direction of horizontal motion of said form during the horizontal motion of said form to thereby cam said clamp mechanism and said closed clamp jaws downward.

4. A method in accordance with claim 3 wherein said closed clamp jaws hold to their cammed downward position after being moved past said cam plate.

5. A method in accordance with claim 2 wherein step (d) includes pulling the closed clamp jaws downward a predetermined amount.

6. A method in accordance with claim 1 wherein step (d) includes pulling the closed clamp jaws downward a predetermined amount.

7. A method in accordance with claim 1 wherein step (b) includes contacting the bottom portion of the hosiery with a ledge of the clamp mechanism and step (c) includes placing an edge of said clamp jaws into contact with a small predetermined amount of hosiery immediately above said ledge.

8. A method in accordance with claim 1 wherein step (c) includes pivoting said clamp jaws to their closed position by actuator means discrete from said form.

9. A method in accordance with claim 8 wherein said clamp jaws are pivotable about generally horizontal axes and are pivoted by the motion of an eccentric surface rotating about a generally vertical axis, said eccentric surface being rotated by the contact of an arm connected thereto with an actuator stop in the path of motion of said arm.

10. A method in accordance with claim 9 including the step of sensing the presence or absence of hosiery on the form and moving the actuator stop out of the path of the arm when hosiery is not on the form.

11. A method in accordance with claim 10 wherein the sensing step includes forming the form of metalic material and placing a resistance sensor in the path of the form at a location where hosiery placed on said form would contact the sensor during motion of the form past said sensor whereby current passes through said sensor when hosiery is not on the form.

12. A method in accordance with claim 11 wherein the step of moving the actuator stop includes connecting said actuator stop to an air cylinder mechanism and controlling the application of air to said air cylinder mechanism through a solenoid controlled by said resistance sensor.

13. A method in accordance with claim 1 including the step of sensing the presence or absence of hosiery on the form and closing said clamp jaws only when hosiery is present on the form.

14. A method of handling hosiery comprising the steps of:

(a) placing a piece of hosiery on a movable form;

(b) moving the form, after the hosiery has been placed on the form, past a clamping station;

(c) moving a clamp mechanism, which is slidably carried by the form, upward until an upper contact surface of the clamp mechanism contacts a bottom portion of the hosiery on the form and moves the bottom portion upward;

(d) closing clamp jaws of the clamp mechanism onto the bottom portion of the hosiery immediately above said upper contact surface after performing step (b); and (e) moving the closed clamp jaws of said clamp mechanism and the hosiery held thereby downward a predetermined amount.

15. A method in accordance with claim 14 wherein step (c) includes upwardly driving an elevator mechanism, discrete from said clamp mechanism, and coupling said clamp mechanism to said elevator mechanism during its motion past said clamping station.

16. A method in accordance with step 15 including the step of setting an adjustable stop mechanism to a predetermined height for stopping said elevator mechanism when it reaches said predetermined height.

17. A method in accordance with claim 15 wherein step (e) includes releasing said clamp mechanism from the lifting power of said elevator mechanism and applying a downward force on said clamp mechanism.

18. A method in accordance with claim 17 wherein the downward force is applied on said clamp mechanism by contacting a portion of said clamp mechanism with a downwardly sloping cam plate and moving said clamp mechanism past said cam plate.

19. A method in accordance with claim 14 wherein step (d) includes pivoting said clamp jaws to their closed position by passing said clamp mechanism past an actuator stop discrete from said clamp mechanism which actuates means for pivoting said clamp jaws to their closed position.

20. A method of handling hosiery comprising the steps of:

(a) moving a form for holding hosiery past a hosiery loading station;

(b) moving the form past a clamp station;

(c) moving a clamp mechanism, which is slidably carried by the form, upward past a point where a bottom portion of hosiery to be placed on the form should be located;

(d) sensing the presence or absence of hosiery on the form;

(e) closing clamp jaws of the clamp mechanism on a bottom portion of hosiery if hosiery has been sensed in step (d) after a portion of the clamp mechanism has contacted and moved a portion of the hosiery upward; and (f) moving the clamp jaws, if closed, downward a predetermined degree.

* * * * *

UNITED STATES PATENT AND TRADEMARK OFFICE

CERTIFICATE OF CORRECTION

PATENT NO. : 4,515,299

DATED : May 7, 1985

INVENTOR(S) : James H. Sewell et al.

It is certified that error appears in the above-identified patent and that said Letters Patent is hereby corrected as shown below:

Column 1, line 4, after "This application" insert —is a division, of"; and

Column 5, line 55, "158" should be —148—.

Signed and Sealed this

*Thirteenth* Day of *August 1985*

[SEAL]

*Attest:*

DONALD J. QUIGG

*Attesting Officer*

*Acting Commissioner of Patents and Trademarks*